US007775748B2

(12) United States Patent
Koenig et al.

(10) Patent No.: US 7,775,748 B2
(45) Date of Patent: Aug. 17, 2010

(54) SHIELD SUPPORT

(75) Inventors: Johannes Koenig, Augsburg (DE); Martin Reuter, Dachau (DE)

(73) Assignee: MARCO Systemanalyse und Entwicklung GmbH, Dachau (DE)

( * ) Notice: Subject to any disclaimer, the term of this patent is extended or adjusted under 35 U.S.C. 154(b) by 140 days.

(21) Appl. No.: 12/177,305

(22) Filed: Jul. 22, 2008

(65) Prior Publication Data

US 2009/0035072 A1 Feb. 5, 2009

(30) Foreign Application Priority Data

Jul. 31, 2007 (DE) ..... 10 2007 035 848

(51) Int. Cl.
*E21D 23/16* (2006.01)
*E21D 15/44* (2006.01)

(52) U.S. Cl. ..... 405/302; 405/297; 405/296

(58) Field of Classification Search ..... 405/288, 405/290, 291, 292, 293, 294, 295, 296, 297, 405/298, 299, 302; 299/10, 11, 12
See application file for complete search history.

(56) References Cited

U.S. PATENT DOCUMENTS

| | | | | |
|---|---|---|---|---|
| 3,437,010 | A * | 4/1969 | Ratz et al. | 405/295 |
| 3,672,174 | A * | 6/1972 | Von Hippel | 405/295 |
| 4,465,408 | A * | 8/1984 | Krieger et al. | 405/302 |
| 4,474,510 | A * | 10/1984 | Bull | 405/292 |
| 4,722,574 | A * | 2/1988 | Barham et al. | 405/302 |
| 4,755,084 | A * | 7/1988 | Peters et al. | 405/294 |
| 4,887,935 | A * | 12/1989 | Koppers et al. | 405/302 |
| 5,423,638 | A | 6/1995 | Merriman | |
| 6,056,481 | A | 5/2000 | Watermann et al. | |
| 6,857,705 | B2 | 2/2005 | Hainsworth et al. | |

FOREIGN PATENT DOCUMENTS

| | | | |
|---|---|---|---|
| CA | 985056 | A | 3/1976 |
| CA | 989185 | A | 5/1976 |
| CA | 991870 | A | 6/1976 |
| DE | 197 49 052 | C1 | 12/1998 |
| DE | 196 36 389 | B4 | 3/2004 |
| EP | 1 231 473 | A1 | 9/2001 |
| JP | 01263399 | A * | 10/1989 |

OTHER PUBLICATIONS

German Search Report and Translation of German Search Report, German Application No. 10 2007 035 848.4, dated Mar. 26, 2008, 4 pages.

Precision +/– 1.7 g Single-/Dual-Axis iMEMS Accelerometer, ADXL103/ADXL203, Analog Devices, copyright 2006, Rev. A, one page.

Kelly, Michael, Hainsworth, David, Outcomes of the Landmark Longwall Automation Project with Reference to Ground Control Issues, 24th International Conference on Ground Control Mining, Aug. 3-5, 2004, pp. Cover Page, Table of Contents, 66-73, NIOSH, Washington, D.C.

(Continued)

*Primary Examiner*—Frederick L Lagman
(74) *Attorney, Agent, or Firm*—Lewis and Roca LLP

(57) ABSTRACT

A shield support for underground mining has a slider and a roof bar between which a ram is arranged, with an inclination detector being provided with which the inclination of the roof bar can be measured.

11 Claims, 2 Drawing Sheets

OTHER PUBLICATIONS

Figure 1:
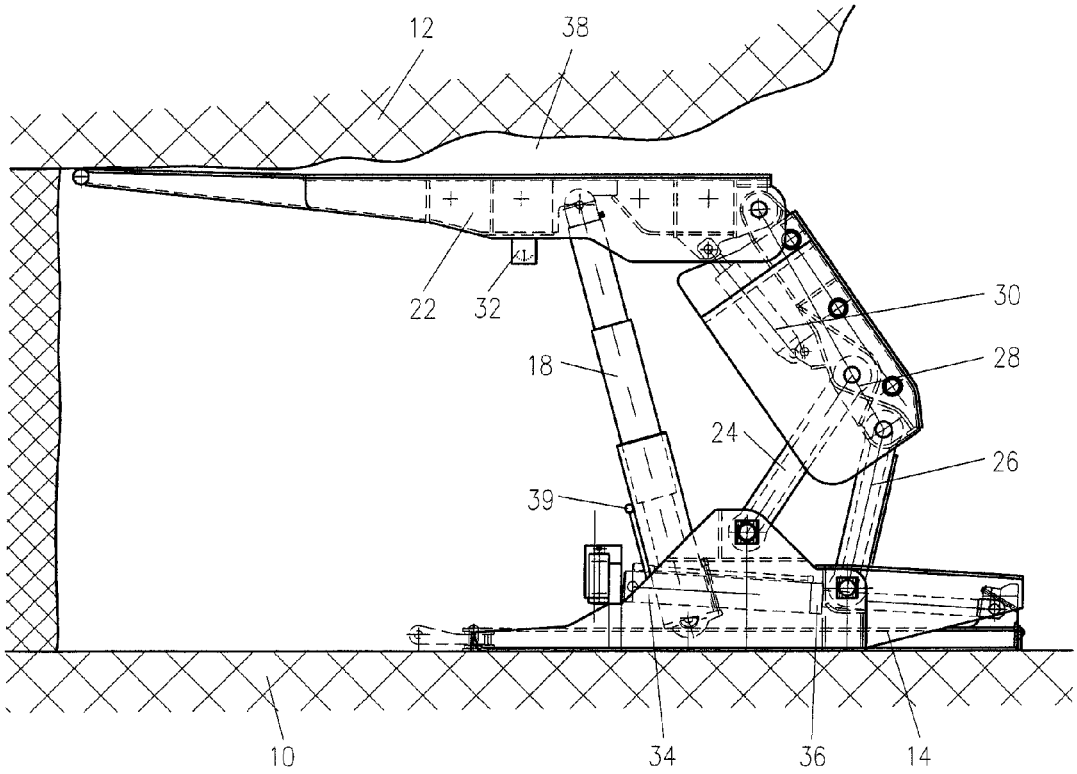

Scannell, Bob, "Integrated MEMS Sensors for Industrial Control," [Internet] www.newarkinone.thinkhost.com/.../Integrated_MEMs_Sensors_for_Industrial_Control.pdf, first published by EPN Magazine, Jan. 2007, 2 pages.

"Low Power Accelerometer Family from VTI . . . ," VTI Technologies Oy, Sensor news 7 technical articles in weeks 33-34/2006, http://www.sens2binternational .com/sensor_news/sensor_sensors..., 2 pages.

VTI's new 3-axis accelerometers for broad range of consumer applications, VTI—Press releases, http://www.vti.fi/en/news-events/press-releasess/view/, Jul. 3, 2006, 2 pages.

* cited by examiner

SHIELD SUPPORT

CROSS-REFERENCE TO RELATED APPLICATION

This application claims priority to German Patent Application Number 10 2007 035 848.4, filed Jul. 31, 2007, which is hereby incorporated by reference as if set forth herein.

BACKGROUND OF THE INVENTION

1. Field of the Invention

The present invention relates to a shield support for underground mining having a slider and a roof bar between which at least one ram is arranged.

2. The Prior Art

Shield supports of this type have the task in underground mining of supporting the roof and of preventing too early a collapse of the roof in that it is supported by the roof bar. It can, however, occur in practice that parts of the roof have already collapsed before the roof bar of the shield support was able to be set for support so that a burst arises in the roof. If the shield support subsequently advances and if the rams are then, as usual in part, are automatically set to an adjustable setting pressure, the roof bar would be pressed into the burst, whereby not only the roof bar, but the whole shield support might be damaged. It is furthermore sensible for the avoidance of further bursts to support the roof as close as possible to the coal face. This in turn means that the roof bar of the shield support should be held in the direction of the interface between the roof and the coal.

It is therefore the object of the invention to improve a shield support of the initially named kind such that damage to the shield is prevented and an ideal support of the roof is ensured.

BRIEF DESCRIPTION OF THE INVENTION

According to the present invention, a shield support for underground mining has a slider and a roof bar between which at least one ram is arranged. At least one inclination detector is provided at the roof bar of the shield support, and includes three acceleration sensors, whose measuring axes extend substantially orthogonally to one another. The shield support includes a progress mechanism having a progress path sensor wherein a measuring device is provided which determines the course of the roof from the signals of the progress path sensor and of the inclination detector.

It has namely surprisingly been found that an inclination detector including a plurality of acceleration sensors with substantially orthogonal measuring axes can be used particularly easily as an inclination detector for a shield support in underground mining. In particular if the inclination detector includes three acceleration sensors whose measuring axes extend substantially orthogonally to one another, the inclination detector can be mounted at any position on the shield support, with each change of the component at which the inclination detector is mounted nevertheless being able to be measured with respect to the direction of gravity.

Advantageous acceleration sensors have a measured zone of approximately ±3 g to ±3 g, with a measuring region from −1 g to +1 g having proven to be sufficient.

If the inclination detector is arranged at the roof bar of the shield support, the inclination of the roof bar can be measured with the help of the inclination detector in the longitudinal direction, i.e. in the advancing direction, and also the transverse inclination of the roof bar, i.e. the inclination of the roof bar with respect to the horizontal, can be measured.

It can furthermore be advantageous to mount an inclination detector to a gob shield of the shield support, whereby in turn the transverse inclination of the shield support can be measured, but also the position of the gob shield with respect to the direction of mining.

In accordance with a further advantageous embodiment, the shield support can have guide parts and an inclination detector can be provided at one or more guide parts as well as at the gob shield, whereby the extended height of the shield can be calculated. It can namely occur due to irregularities during the mining operation that the roof bar of the shield support is not disposed parallel to the roof when the shield support is set. The rams and the roof bar therefore still extend almost at right angles to one another during the setting procedure. If, however, the roof bar is set at the roof at an angle, the roof bar contacts the roof with increasing setting pressure, whereby a torsion arises between the rams and the roof bar which can permanently damage the shield support. It can also be advantageous for this reason if the angular change of the inclination sensor mounted at the roof bar and simultaneously the pressure increase in the ram are measured during the setting. It is hereby possible on an increase in the setting pressure and on a simultaneous change in the longitudinal inclination and/or transverse inclination of the roof bar beyond a preset threshold value to abort the setting process or to take out the shield support. The latter provides the possibility of changing the position of the shield after a removal such that the roof bar can be set substantially parallel to the roof in a subsequent setting process.

The inclination sensor in accordance with the invention furthermore provides the possibility of recording the course of the roof in that, in addition to the signals of the inclination detector, the signals of a progress sensor are also recorded which is arranged at a progress mechanism of the shield support. The course of the roof can be determined by a simultaneous measurement of the roof bar inclination and also of the progress path of the shield. A rock burst risk can also be determined with the help of a computer-assisted analysis of this course since the shape of the roof has an influence on the stability of the rock. If the roof, for example, has a concave course similar to an arch, the roof will collapse later than with a convex arching. The shield support in accordance with the invention can thus also be used for the determination of a rock burst risk.

In accordance with a further advantageous embodiment, the inclination detector and a progress path sensor can be used to determine the space-tie coordinates of the shield support relative to the conveyor in order thereby, for example, to carry out a current positional determination of the shield support or to carry out a control of the shield support, in particular robotically, using the determined coordinates.

The present invention will be described in the following purely by way of example with reference to an advantageous embodiment and to the enclosed drawings. These are shown:

BRIEF DESCRIPTION OF THE DRAWING FIGURES

FIG. 1 a side view of a shield support; and

Figure 2:
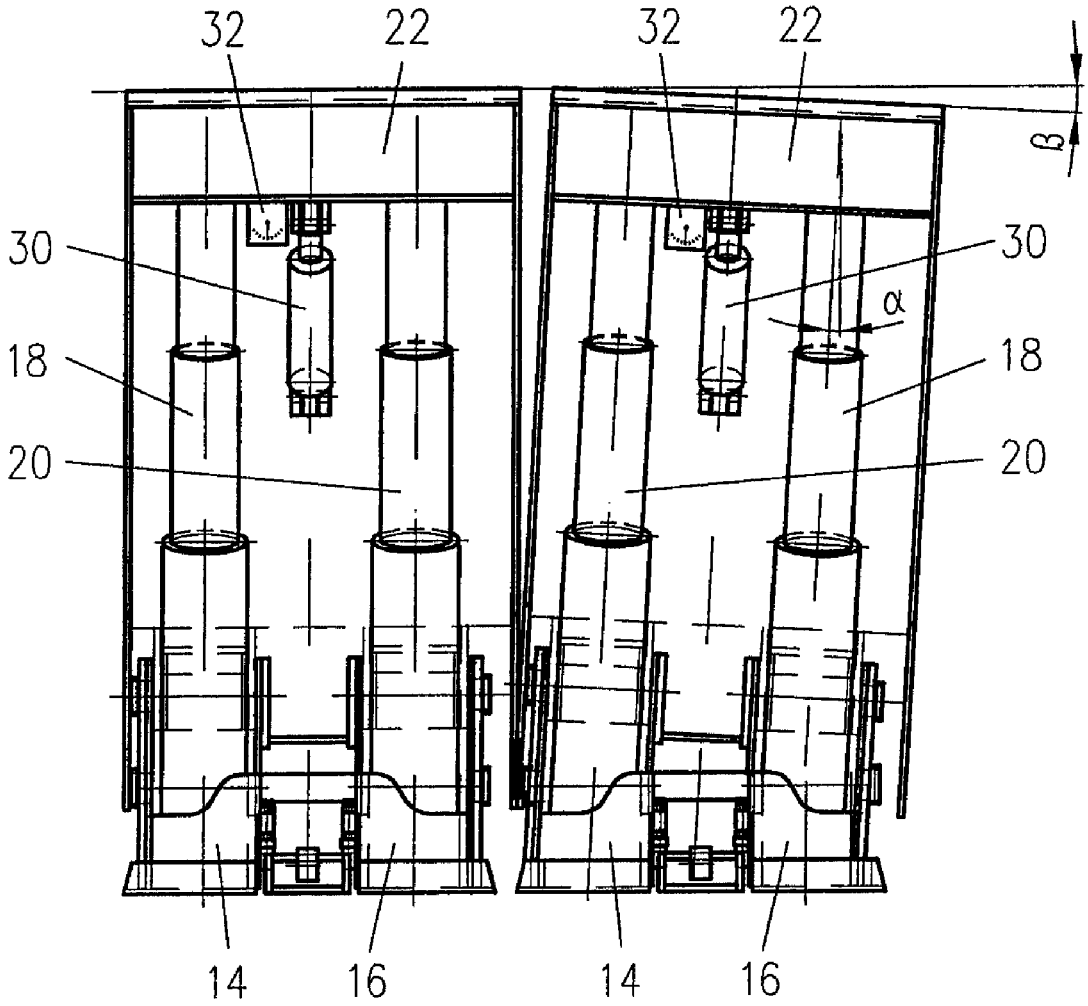

FIG. 2 a rear view of two adjacent shield supports.

DETAILED DESCRIPTION OF THE INVENTION

The following description of preferred embodiments of the invention is not intended to limit the scope of the invention to these preferred embodiments, but rather to enable any person skilled in the art to make and use the invention.

As any person skilled in the art will recognize from the previous description and from the figures and claims, modifications and changes can be made to the preferred embodiments of the invention without departing from the scope of the invention defined in the following claims.

FIG. 1 shows a shield support set between the foot wall 10 and the roof 12 having two sliders 14, 16 (cf. FIG. 2) which are connected via a respective ram 18, to a roof bar 22. The reference numerals 24 and 26 designate guide parts of the lemniscate which are connected to a gob shield 28 to which a rectangular cylinder 30 is fastened with whose help the inclination of the roof bar 22 can be set.

An inclination detector shown purely schematically is designated by the reference numeral 32 and is fastened to the lower side of the roof bar 22. The inclination detector 32 in the embodiment shown has three acceleration sensors which are of separate construction and whose measuring axes extend orthogonally to one another, whereby a measurement of the roof bar inclination is possible both in the longitudinal direction (FIG. 1) and in the transverse direction (FIG. 2) independently of the mounting position. The measured zone of the acceleration sensors used amounts to approximately ±1 g. Furthermore, alternatively or additionally, inclination detectors can also be provided at the gob shield 28 and/or at one or both guide parts 24 and 26.

Furthermore, the support shield shown in the Figures has a progress mechanism 34 having a progress path sensor, with a measuring device (not shown) being provided which determines the course of the roof from the signals of the progress path sensor 36 and of the inclination detector 32. This measuring device furthermore determines the longitudinal inclination and the transverse inclination of the roof bar 22. In addition, the measuring device is made such that it detects the longitudinal inclination and the transverse inclination of the roof bar 22 during a setting procedure as well as a setting pressure measured with the help of a pressure sensor 39.

A control is connected to the shield support described above which calculates the extended height of the shield with the help of an inclination detector which is provided at one of the guide parts 24 and 26 as well as with the help of a further inclination detector which is provided at the gob shield 28. This calculation can take place independently of a longitudinal inclination or transverse inclination of the shield thanks to the inclination detectors used.

Furthermore, the measuring device as well as the shield control are made such that the recorded course of the roof 12 is analyzed in a computer-assisted manner so that it can be determined whether a burst 38 is present above the roof bar 22. The risk of a rock burst can be determined in this manner and/or more precise statements can be made on a possible risk whether the roof will collapse.

The longitudinal inclination and the transverse inclination of the roof bar 22 are measured on the setting of the shield support and the setting pressure of the two rams 18 and 20 is simultaneously measured. If in this process, for example, the situation shown in FIG. 1 is present that the roof bar 22 should be set beneath a burst 38, it can be determined by the measurement of the longitudinal inclination of the roof bar and also of the setting pressure that the roof bar is being pressed in an unwanted manner into the burst 38 so that the setting procedure can be aborted or the shield support can be removed. It is subsequently possible by a movement of the shield support to position it such that the roof bar can be set substantially parallel to the roof on a subsequent setting.

We claim:

1. A shield support for underground mining having a slider and a roof bar between which at least one ram is arranged, wherein at least one inclination detector is provided at the roof bar of the shield support, said inclination detector including three acceleration sensors, whose measuring axes extend substantially orthogonally to one another, said shield support comprising a progress mechanism having a progress path sensor wherein a measuring device is provided which determines the course of the roof from the signals of the progress path sensor and of the inclination detector.

2. A shield support in accordance with claim 1, characterized in that the measured zone of the acceleration sensors amounts to approximately ±1 g to approximately ±3 g.

3. A shield support in accordance with claim 1, characterized in that it has a gob shield and an inclination detector is arranged at the gob shield.

4. A shield support in accordance with claim 1, characterized in that the shield support has guide parts and an inclination detector is arranged at a guide part.

5. A shield support in accordance with claim 1, characterized in that the shield support is connected to a measuring device which detects a longitudinal inclination and/or a transverse inclination of the roof bar.

6. A shield support in accordance with claim 5, characterized in that the ram is provided with a pressure sensor; and in that the measuring device is made such that it detects the longitudinal inclination and/or transverse inclination of the roof bar and the setting pressure during a setting process.

7. A method for risk analysis in underground mining with a shield support having a slider and a roof bar between which at least one ram is arranged, wherein at least one inclination detector is provided at the shield support, said inclination detector including three acceleration sensors, whose measuring axes extend substantially orthogonally to one another, wherein said inclination detector is arranged at the roof bar, wherein the shield support has a progress mechanism having a progress path sensor; and wherein a measuring device is provided which determines the course of the roof from the signals of the progress path sensor and of the inclination detector, wherein the course of the roof is recorded and a rock burst risk is determined with a computer-assisted analysis of the course.

8. A method for the control of a shield support during a setting process, the shield support having a slider and a roof bar between which at least one ram is arranged, wherein at least one inclination detector is provided at the shield support, said inclination detector including three acceleration sensors, whose measuring axes extend substantially orthogonally to one another, wherein the shield support is connected to a measuring device which detects a longitudinal inclination and/or a transverse inclination of the roof bar, wherein the ram is provided with a pressure sensor and wherein the measuring device detects the longitudinal inclination and/or transverse inclination of the roof bar and the setting pressure during a setting process, wherein the longitudinal inclination and/or transverse inclination of the roof bar as well as the setting pressure are measured during the setting process and the setting procedure is ended or the shield support is removed on an increase of the setting pressure and a simultaneous change of the longitudinal inclination and/or transverse inclination of the roof bar above a preset threshold value.

9. A method in accordance with claim 8, characterized in that, after a removal of the shield support, the position of the shield support is changed such that the roof bar can be set substantially parallel to the roof in the subsequent setting process.

10. A method for the positional determination of a shield support for underground mining having a slider and a roof bar between which at least one ram is arranged, wherein at least one inclination detector is provided at the shield support, said inclination detector including three acceleration sensors, whose measuring axes extend substantially orthogonally to one another, wherein an inclination detector is arranged at the roof bar, wherein the shield support has a progress mechanism having a progress path sensor; and a measuring device is provided which determines the course of the roof from the signals of the progress path sensor and of the inclination detector, wherein the space-time coordinates of the shield are detected relative to a conveyor with the help of the inclination detector and of the progress path sensor.

11. A method in accordance with claim 10, characterized in that the space-time coordinates are used for an automated control of the shield.

* * * * *